US007165328B2

(12) United States Patent
Garukyan

(10) Patent No.: US 7,165,328 B2
(45) Date of Patent: Jan. 23, 2007

(54) DOUBLE ACTION SCISSORS (DAS)

(75) Inventor: Grigor Garukyan, 601 Hawthorne St #5, Glendale, CA (US) 91204

(73) Assignee: Grigor Garukyan, Los Angeles, CA (US)

( * ) Notice: Subject to any disclaimer, the term of this patent is extended or adjusted under 35 U.S.C. 154(b) by 0 days.

(21) Appl. No.: 10/894,072

(22) Filed: Jul. 19, 2004

(65) Prior Publication Data

US 2005/0039336 A1 Feb. 24, 2005

Related U.S. Application Data

(60) Provisional application No. 60/496,546, filed on Aug. 21, 2003.

(51) Int. Cl.
*B26B 1/00* (2006.01)

(52) U.S. Cl. ..... 30/123; 30/134; 30/135; 606/174

(58) Field of Classification Search ..... 30/134, 30/135, 124, 123, 186, 112, 195, 233; 606/138, 606/174, 167
See application file for complete search history.

(56) References Cited

U.S. PATENT DOCUMENTS

| | | | | | |
|---|---|---|---|---|---|
| 257,389 | A | * | 5/1882 | Sager | 30/134 |
| 594,072 | A | * | 11/1897 | Forde | 30/134 |
| 835,791 | A | * | 11/1906 | Kelly | 30/135 |
| 1,004,404 | A | * | 9/1911 | Fordyce | 30/233.5 |
| 1,876,218 | A | * | 9/1932 | Gee | 30/134 |
| 3,842,500 | A | * | 10/1974 | Cassel | 30/124 |
| 3,908,268 | A | * | 9/1975 | Brown | 30/124 |
| 4,404,746 | A | * | 9/1983 | Jansson et al. | 30/124 |
| 4,850,110 | A | * | 7/1989 | Meier, Jr. | 30/135 |
| 5,346,500 | A | * | 9/1994 | Suchart | 606/138 |
| 5,920,990 | A | * | 7/1999 | Mooney | 30/124 |

* cited by examiner

*Primary Examiner*—Allan N. Shoap
*Assistant Examiner*—Ghassem Alie

(57) ABSTRACT

A scissors for cutting, holding, and then releasing an elongated piece of string. The scissors includes a pair of conventional scissors with a spring-clip attachment. The spring-clip has a long leg, a short leg, and a semi-circular bottom portion attaching the legs together. The short leg is rigidly mounted to a first blade arm of the conventional scissors. While the blade arms pivot toward one another, a portion of the string is retained within the attachment after it is cut and then released from the attachment upon opening of the blade arms.

1 Claim, 8 Drawing Sheets

DOUBLE ACTION SCISSORS (DAS)

CROSS-REFERENCE TO RELATED APPLICATIONS

This non-provisional application is related to the provisional application filed on Aug. 21, 2003, application No. 60/496,546

STATEMENT REGUARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The invention, DAS, is related to any mechanical process that cuts an object into two pieces and at the same time grabs either piece of that cut object.

BRIEF SUMMERY OF THE INVENTION

A double action scissors for cutting a piece of string in which the scissors is a conventional scissors having first and second blade arms pivoting toward one another in a first position and pivoting away from one another in a second position. The scissors includes a conventional scissors and a substantially U-shaped spring clip, which is secured to a blade of the scissors. The spring-clip is made from a flat spring sheet, which has an unsymmetrical fold (greater than 90 degrees), which produces a spring clip having one leg or side longer than the other leg or side. The spring-clip has a short leg and a long leg. The spring-clip includes a semi-circular bottom portion, which connects the first and second leg together. The short leg is welded to the first blade arm of the conventional scissors. The long leg of the spring-clip has a curved protrusion at its free end and is tilted slightly towards the short leg of the spring-clip. When the blade arms pivot toward one another, the string is cut and a portion of the cut string is retained within a formed gap between the second blade arm and the long leg of the spring-clip. The cut end of the string is held against an outer surface of the second blade arm by a biasing force created by the second leg of the spring clip. While the blade arms pivot away from one another, the same biasing force assists with the release of the string from the spring clip.

BRIEF DESCRIPTION OF THE SEVERAL VIEWS OF THE DRAWINGS

The invention will be described in more detail using references to the appended drawings.

DETAILED DESCRIPTION OF THE INVENTION

Figure 1:
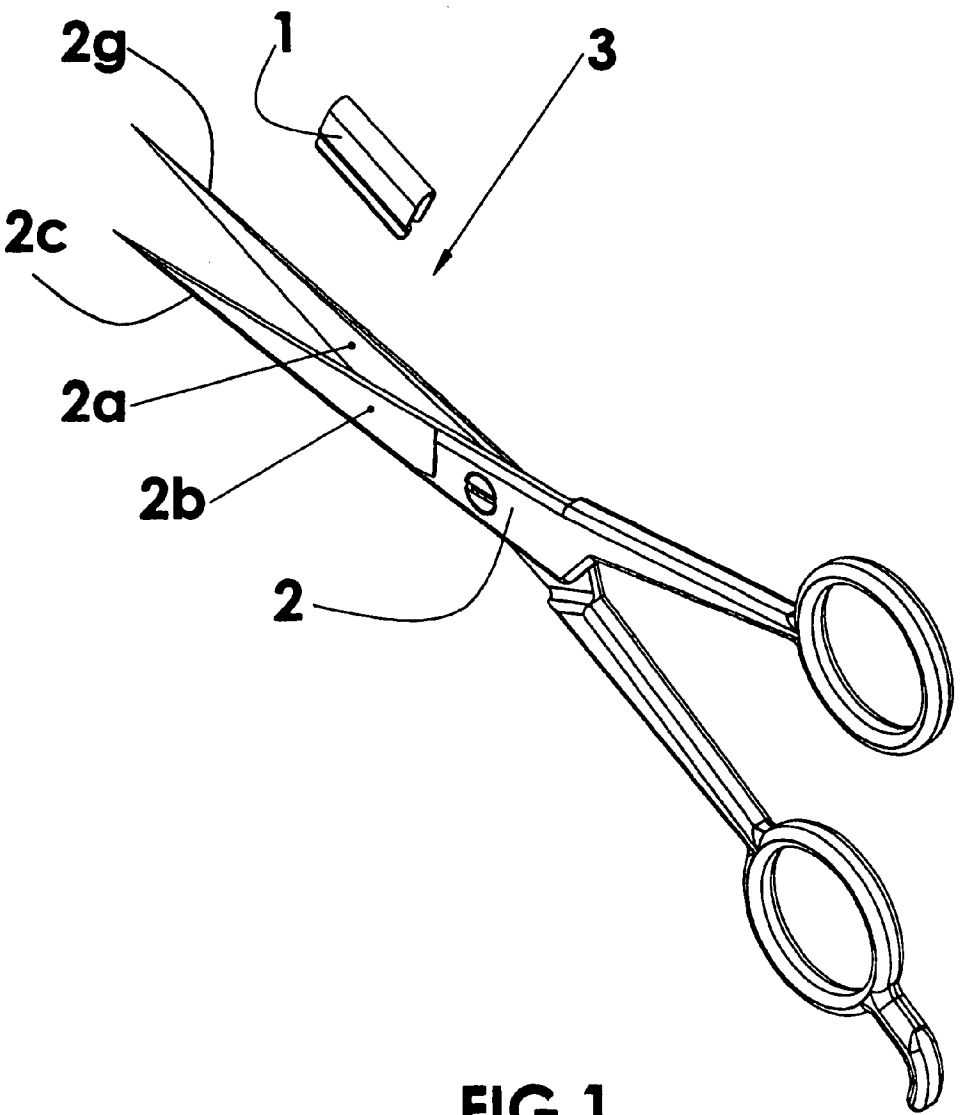
FIG. 1 is a perspective view of the double action scissors before assembly.
Figure 2:
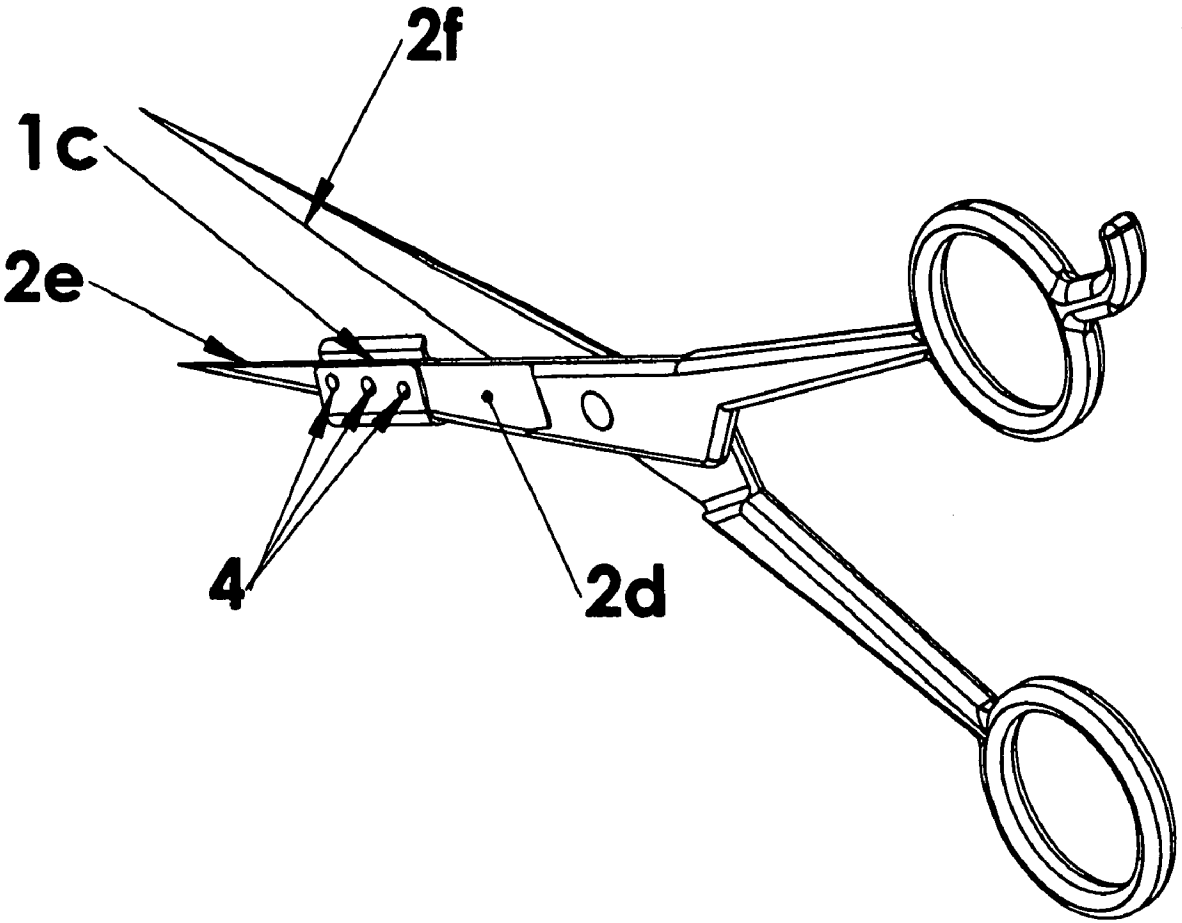
FIG. 2 is a view of the assembled double action scissors.
Figure 3:
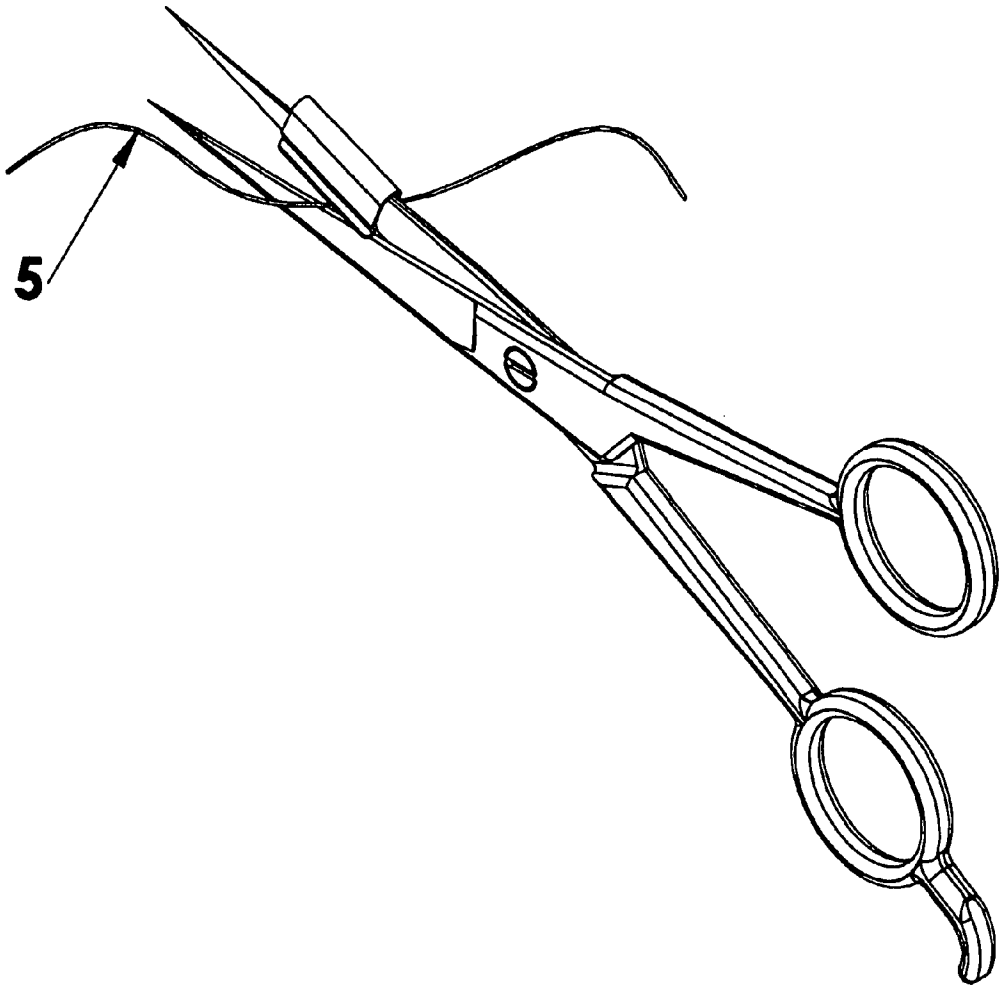
FIG. 3 is a view of the double action scissors and a piece of string before being cut.
Figure 4:
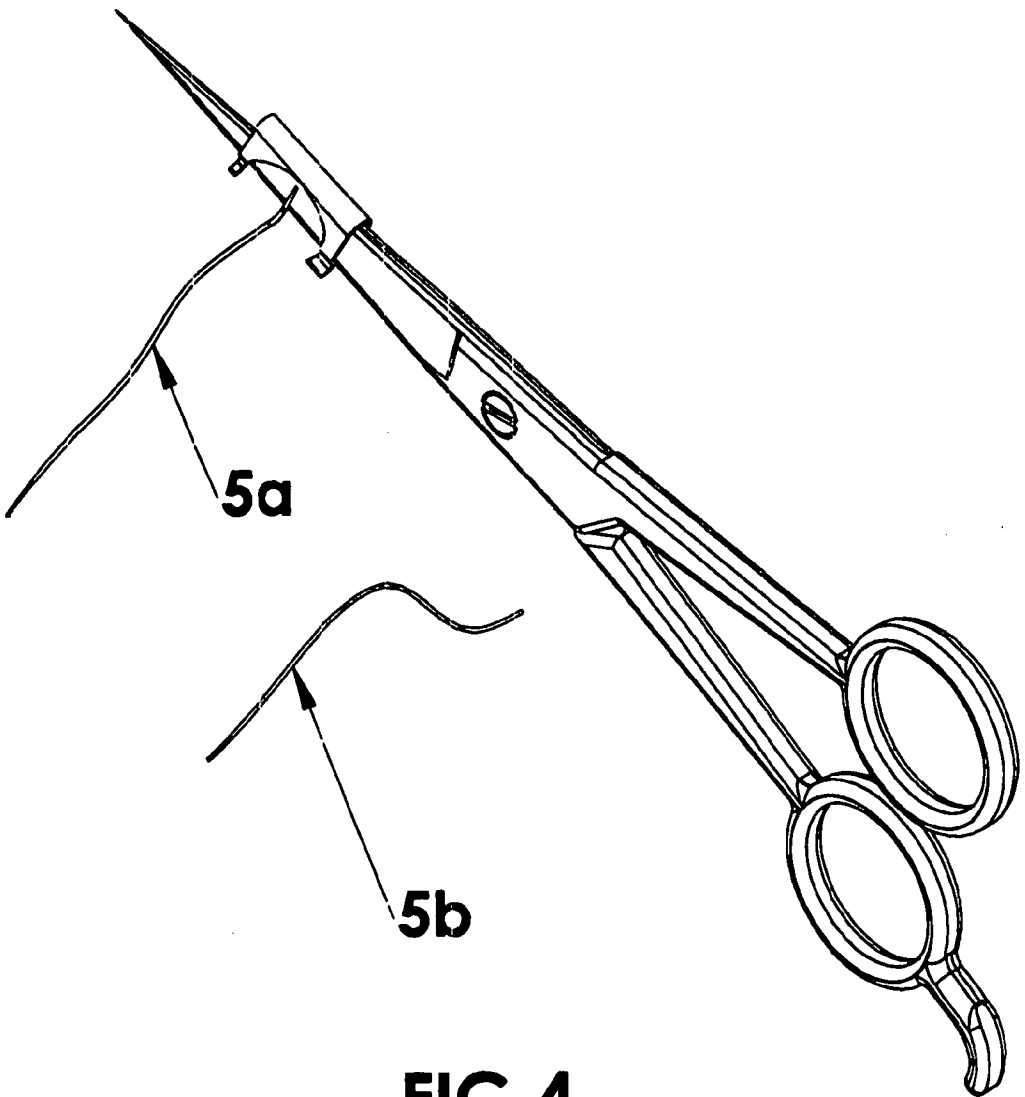
FIG. 4 is a view of the cut and held pieces of string by the double action scissors.
Figure 5:
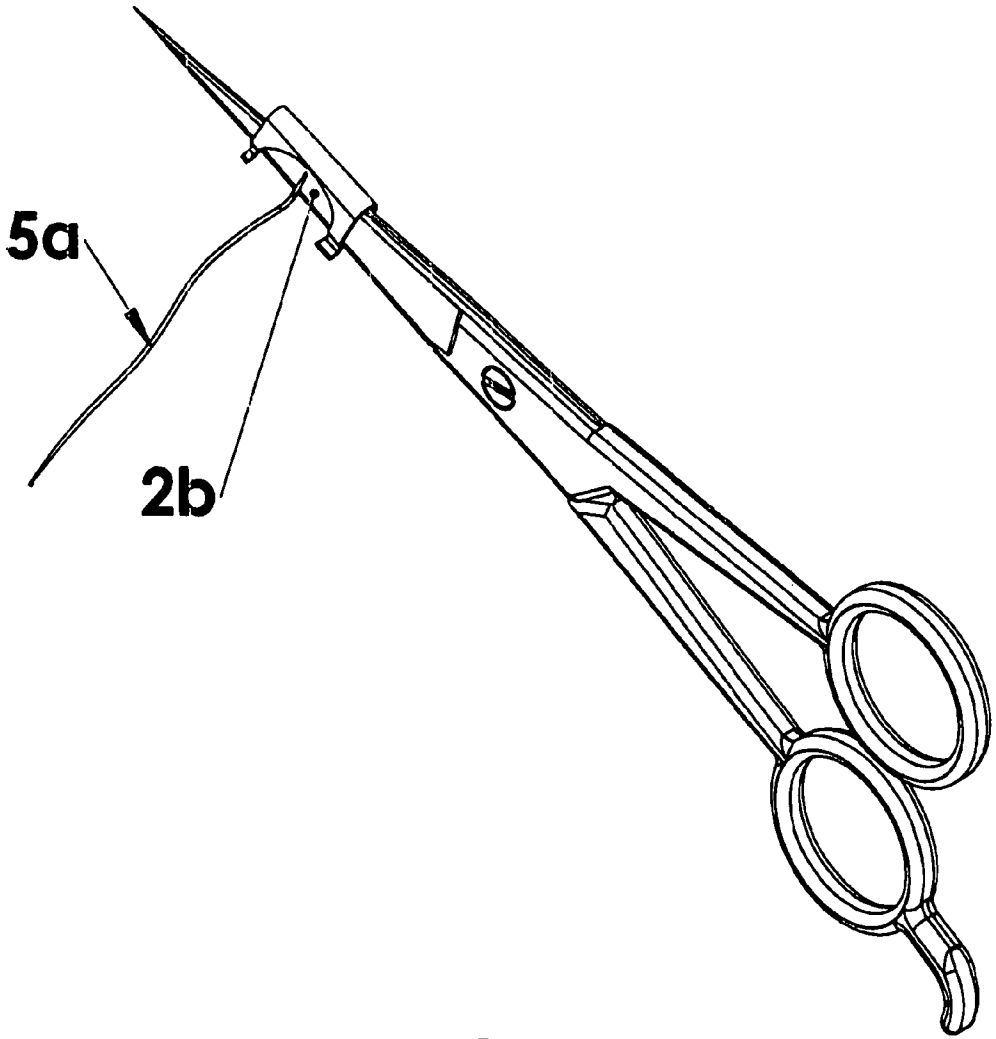
FIG. 5 is a view of a second embodiment of the invention depicting a spring-clip having a cut out section.
Figure 6:
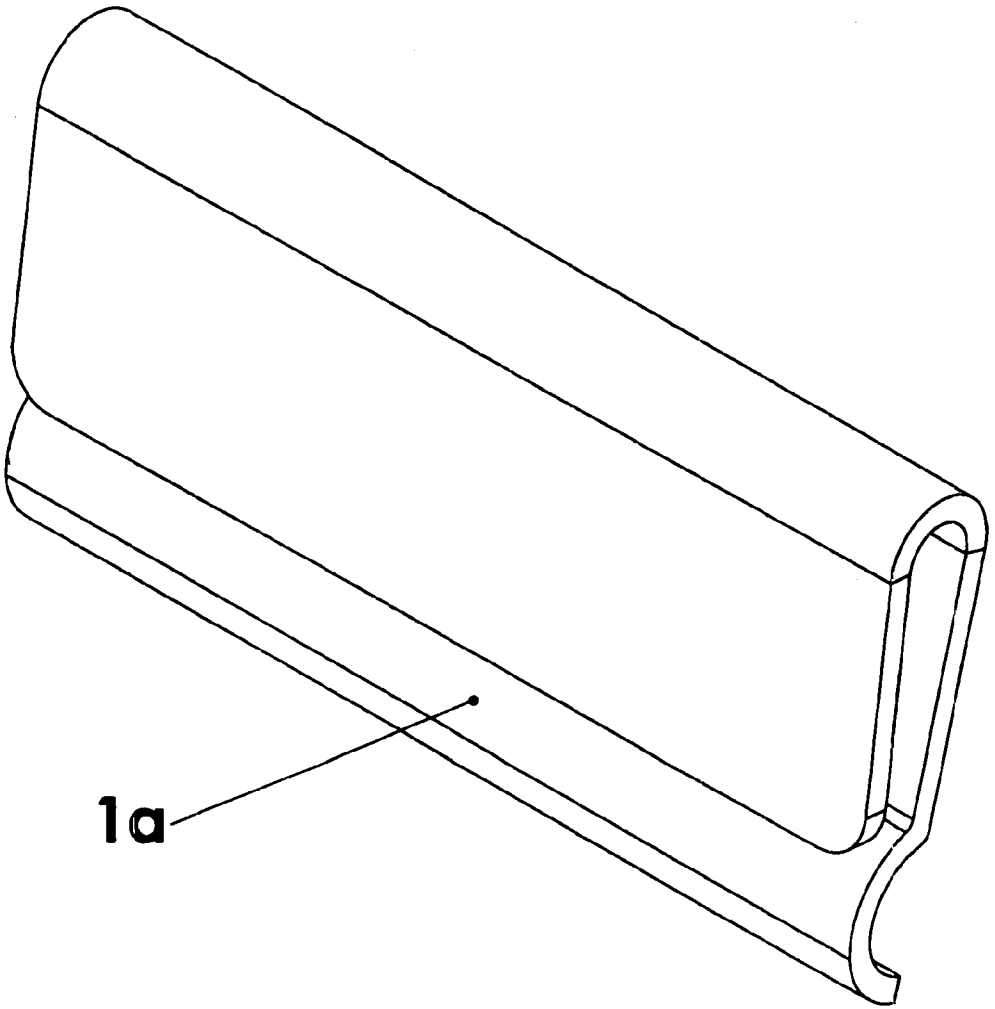
FIG. 6 is another view of the spring-clip in FIG. 1.

The double action scissors 1 includes a spring-clip 1 attached to a pair of conventional scissors 2 for cutting an object 5 into two 5*a*, 5*b*. The spring-clip is metallic and the object being cut, for explanatory purpose, is a piece of string 5. The pair of conventional scissors 2 has a first blade arm 2*g* and a second blade arm 2*c* pivoting toward one another in a first position and pivoting away from one another in a second position. The first blade arm 2*g* has an outer surface 2*d* and a cutting edge 2*e*. The second blade arm 2*c* has an inner surface 2*a* and a cutting edge 2*f*. The spring-clip 1 is substantially U-shaped and is formed by a mechanical (blanking-bending), thermal, and electrical treatment of a flat spring sheet metal. Spring-clip 1 has short and long legs connected together with a semi-circular bottom portion. The short leg of the spring-clip is welded in direction 3 to the first blade arm 2*g* of the conventional scissors 2 in a manner that the free edge of the short leg is aligned with the cutting edge 2*e* of the first blade arm 2*g*. Spring-clip 1 is spot welded on the surface 2*d* of the first blade arm 2*g* of the first blade arm 2*g* of the scissors 2. The number of the weld spots is chosen accordingly to the size of the spring-clip and the rigidity of the material need to be cut. In this case, for cutting a piece of string, three weld spots 4 can be used for welding the first leg of the spring-clip to the outer surface 2*d* of the first blade arm 2*g*.

Figure 7:
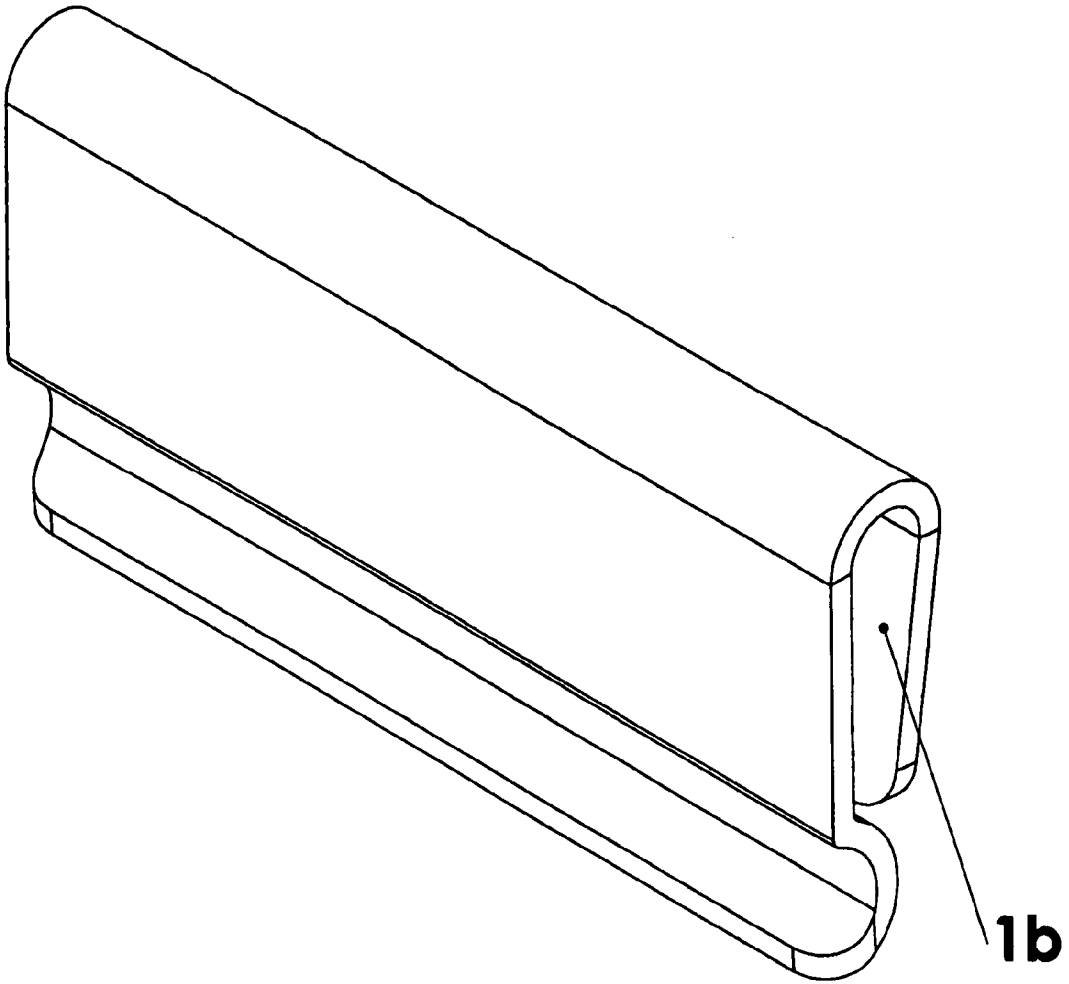
FIG. 7 is another view of the spring-clip in FIG. 1.
Figure 8:
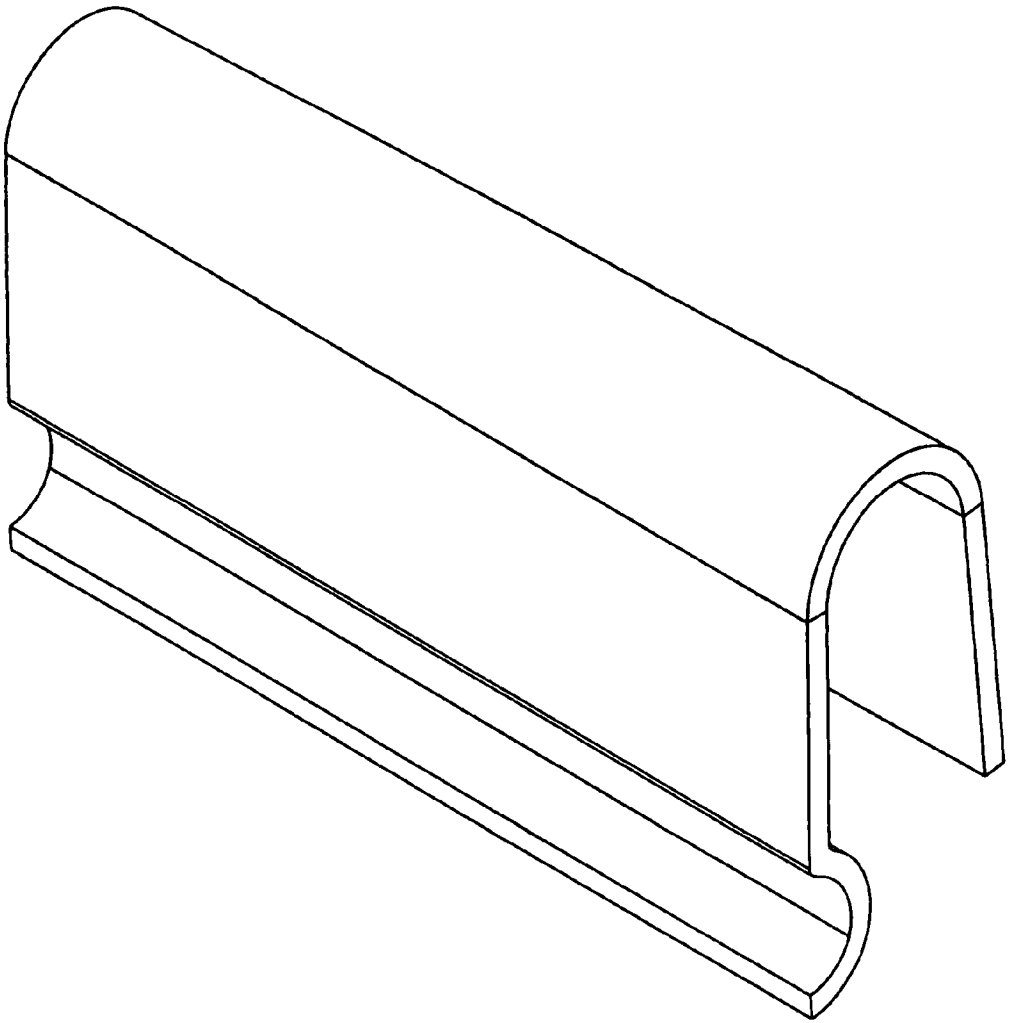
FIG. 8 is a view of a the spring-clip having its sides apart under tension.

The second leg of the spring-clip is tilted towards the first leg of the spring-clip. The legs of the spring-clip must be held close together before welding. After welding, the two legs of the spring-clip are further apart due to the initial tension between the two legs of the spring-clip as shown in FIG. 7. There is also an initial tension between the spring-clip and the scissors, which allow the end of the cut string, slide in-between the inner surface 2*a* of the second blade arm 2*c* of the conventional scissors 2 and the second leg of the spring clip 1. The second leg of the spring-clip has a flat portion and a curved protrusion 1*a* at the free end of the flat portion for biasing one end of the cut string against an outer surface of the first blade arm. In the first position where the blade arms pivoted toward one another, the piece of string is cut by shear cutting action of the cutting edges of the blase arms. Then the cut end 5*a* of the string with the second blade arm of the scissors enters into the U-shaped spring-clip. In the second position where the blade arms pivoted away from one another, the cut end 5*a* of the string is forced out of the U-shaped spring-clip by the second blade arm and the biasing force between the spring clip and the outer surface of the second blade arm.

The double action scissors is intended for use as a tool in everyday life in different professions. For example, surgeons can use it during many types of surgeries; it can also be used by electricians, tailors, and leather workers and in other fields. The manufacturing of the double action scissors is easy and very inexpensive because one only needs to attach a spring-clip to a pair of conventional scissors. The double action scissors also helps maintain a clean work environment since the double action scissors holds one piece of the object that is being cut. Anyone who uses a pair of conventional scissors can use the double action scissors with the same ease.

I claim:

1. The combination of a scissors and attachment to expedite cutting string, said scissors having first and second blade arms pivoting toward one another in a first position and pivoting away from one another in a second position, said attachment comprising a substantially U-shaped spring-clip made from a thin flat metal sheet, the spring-clip including first and second legs connected together by a semi-circular bottom portion, wherein the first leg is longer than the second leg and the first leg having a flat portion and a curved portion extending above the flat portion, said second leg having a flat portion, a free end and an opposing end attached to the said semi-circular bottom portion, said second leg being rigidly mounted to an outer surface of said second blade arm, said first leg being biases toward said second leg such that the free end of the first leg is closer to said flat portion of said second leg than the opposing end of the first leg, whereby when a string is cut by shear cutting action of the blade arms in said first position, a portion of the string is forced into a gap between said first leg and said second lade arm and the string then being released upon blade arms moving to said second position.

* * * * *